US006745486B2

(12) United States Patent
Stetson-Buck

(10) Patent No.: US 6,745,486 B2
(45) Date of Patent: Jun. 8, 2004

(54) METHOD AND APPARATUS FOR FRENCH MANICURES

(76) Inventor: Jannette Stetson-Buck, 37648 Dixie Dr., Palmdale, CA (US) 93550

( * ) Notice: Subject to any disclaimer, the term of this patent is extended or adjusted under 35 U.S.C. 154(b) by 22 days.

(21) Appl. No.: 10/067,316

(22) Filed: Nov. 19, 2001

(65) Prior Publication Data

US 2003/0145478 A1 Aug. 7, 2003

(51) Int. Cl.[7] ..... A45D 29/05

(52) U.S. Cl. ..... 33/669; 33/18.1; 33/41.3; 33/512; 132/73.6

(58) Field of Search ..... 33/18.1, 19.1, 33/20.1, 21.1, 41.1, 41.3, 41.4, 41.5, 42, 44, 512, 666, 669; D15/138, 139; 132/73, 73.5, 73.6, 75.3, 75.4, 75.5; 30/26, 27; D28/56, 57, 58, 62; 83/863, 875, 886, 887

(56) References Cited

U.S. PATENT DOCUMENTS 938,227 A * 10/1909 Durkee ..... 132/73.6
1,115,337 A * 10/1914 Rossetter ..... 132/73.6
2,559,825 A * 7/1951 McKinney, Jr. ..... 132/73
2,597,526 A * 5/1952 Kessler ..... 132/73.6
4,370,910 A * 2/1983 Suzuki et al. ..... 83/887
D273,194 S * 3/1984 House ..... D15/139
4,767,648 A * 8/1988 Hokama et al. ..... 132/73
D309,464 S * 7/1990 Salomonsson ..... D15/138
5,348,029 A * 9/1994 Garcia Rodriguez ..... 132/73.5

* cited by examiner

*Primary Examiner*—Christopher W. Fulton
(74) *Attorney, Agent, or Firm*—James M. Duncan

(57) ABSTRACT

A marking drill bit used in combination with a motorized handset is disclosed for use by manicurists in applying french manicures. The marking drill bit scribes marks into an overlay which are used by the manicurist to set the length of the nail tip and to apply accurate widths of acrylic or gel overlay of contrasting colors. A guide is also disclosed which may assist the manicurist in placing the marking drill bit on the overlay.

8 Claims, 5 Drawing Sheets

METHOD AND APPARATUS FOR FRENCH MANICURES

BACKGROUND OF THE INVENTION

The present invention relates to a method and apparatus for performing fingernail manicures, and more particularly to a method and apparatus for applying a French manicure to fingernails which already have existing artificial fingernail enhancements.

The human fingernail is made up of keratinised epidermal cells. The nail plate is a hard keratin coating that protects the fingertip and underlying tissue. The nail bed, which contains blood vessels which supply nutrients to the fingertip, is the portion of skin upon which the nail plate rests. The matrix is that part of the nail bed which extends beneath the nail root and contains lymph and blood vessels. The matrix produces the nail, the cells undergoing a reproducing and hardening process. The lunula, or half moon, is located at the base of the nail. The area under the lunula is the front of the matrix. The free edge is the portion of the nail plate not attached to the nail bed, the free edge being the tips of natural fingernails.

Various methods and devices are known for enhancing the appearance of fingernails and to protect the nail plate from damage from biting, picking, and excessive moisture. Artificial fingernail enhancements are any procedure which lengthens, thickens or alters the appearance of the fingernail through artificial means. Such procedures include the application of artificial tips, acrylics, gels, and fabric wraps. Artificial tips provide an extension of a person's fingernails. The tips are glued to the nail plate for added length and an overlay is applied to strengthen the top and to add support. Acrylics, which are a combination of liquids and powder, are polymers which may be used for overlays and for molding artificial tips. Acrylics provide a material which is flexible, strong and which mimics the flexibility and strength of the natural nail. Gels are similar to acrylics in that they both can be used to extend the length of the nails and make them stronger. Like acrylics, gels can be applied over the natural nail or over artificial nail tips. While often referred to as not being acrylic, gels are based on the same methacrylate and acrylate families as acrylics. However, gels are odorless and are usually cured by exposure to ultraviolet light. A fabric wrap is an application of a silk or linen fabric which is glued to the nail plate and then filed and buffed to a smooth glossy finish.

A French tip manicure, or French manicure, refers to the use of two colors of acrylic applied to the nails to produce a color variation between the natural nail and the tip. The extended tips of the nails may be molded using acrylic, gel or fabric wrap. Alternatively, pre-formed artificial tips may be applied to the natural nail. When pre-formed artificial tips are used, an overlap of the extended tip over the natural nail is necessary. The pre-formed artificial tip extends rearwardly partially covering the natural nail. Unless specified otherwise, the terms "tip," "tips," or "artificial tips" shall henceforth refer to both molded tips and the pre-formed artificial tips previously described.

The tips of a French manicure are usually white in color. The base of the nail is usually overlayed with a pink or flesh tone acrylic. The contrasting colors between the tip and the natural nail provide a sharp and distinct border which stylishly and gracefully adorns the hands of the wearer. This border between the tip and the natural nail formed by the contrasting colors is usually referred to as the "smile line."

However, this border actually mimics the appearance of natural nails, where the "smile line" is the border between the pink or flesh colored nail plate overlying the nail bed, and the white free edge of the nail plate extending past the nail bed. For purposes of this disclosure, the term "artificial smile line" will be used to describe the border between the tip and the natural nail created by the contrasting colors. The term "natural smile line" refers to the border between the naturally pink or flesh colored nail plate overlying the nail bed, and the white free edge of the natural nail plate extending past the nail bed.

As the nail plate grows, a new portion of nail plate at the lunula, adjacent to the cuticle, will not be coated with the acrylic overlay. This growth causes the tip and the artificial smile line to extend further from the fingertip than when the tip was initially applied. The acrylic may also lift away from the natural nail, which allows the accumulation of moisture and/or bacteria between the natural nail and the acrylic. It is therefore necessary for artificial nail applications, including French manicures, to be periodically maintained, usually about every two weeks. During this maintenance, the manicurist will prepare the natural nail for applying new acrylic or gel to the new growth area by trimming away lifted overlay and shortening the tips. A groove is created for application of new acrylic or gel. The manicurist will apply a new layer of white acrylic to the tips, forming a new artificial smile line approximately overlaying the natural smile line, which is usually visible through the pink or flesh colored acrylic or gel. Finally, new pink or flesh colored acrylic or gel will be added to the new growth area over the lunula.

The appearance of a French manicure is enhanced when the artificial tips are the same length on all fingers, when the artificial smile lines are uniformly located on the fingernail, and when the white French tips are the same length from the artificial smile line to the end of the tip on each finger. However, the known practice is for a manicurist to approximate or "eyeball" these dimensions to obtain a set of generally uniform nails. However, depending upon the skills of the particular manicurist, this practice can be inexact, time consuming, and yield less than satisfactory results. An apparatus and method which enables a manicurist to easily obtain a set of uniform nails is desirable.

SUMMARY OF THE INVENTION

The present invention is directed to a method and apparatus which meets the need identified above.

The disclosed apparatus is a fingernail marking drill bit used in combination with a motorized handset. The drill bit is comprised of a shank having a proximal end and a distal end, having a first circular blade attached at its center to the distal end and a second circular blade attached at its center to the shank between the first blade and the proximal end. A gauging segment, which may be used to determine the length of a french manicure, is defined by the distance along the shank between the first blade and the second blade. The blades may be separately attached to the shank, or, as an alternative embodiment, the blades and shank may be configured from a single piece of material.

In another embodiment, the marking drill bit comprises a shank having a proximal end and a distal end. A barrel, having a central axis, extends from the distal end of the shank, the central axis of the barrel coinciding with the longitudinal axis of the shank. The barrel has a top and a bottom, where the bottom of the barrel is adjacent to the distal end of the shank. A first circular blade comprising a first scribing surface is fashioned at the front of the barrel, and a second circular blade, comprising a second scribing surface, is fashioned at the bottom of the barrel. A gauging segment is defined by the axial distance along the barrel between the first blade and the second blade, wherein the gauging segment may be used to determine the length of a french manicure. A first circular stop may be fashioned at the front of the barrel adjacent to the first blade, where the first circular stop has a smaller diameter than the first blade, such that the first circular stop limits the depth of penetration of the first blade into the nail plate. A second circular stop may be fashioned at the bottom of the barrel adjacent to the second blade, the second circular stop having a smaller diameter than the second blade, such that the second circular stop limits the depth of penetration of the second blade into the nail tip.

A method of rendering a french manicure is also disclosed. This method comprises the following steps: (1) the entire nail is prepared by trimming away any lifted overlay; (2) the location of the natural smile line underneath the existing nail enhancement is determined; (3) a drill bit used in combination with a motorized handset is placed on the fingernail, where the drill bit comprises the features of the disclosed apparatus; (4) the first blade is oriented so that the first blade is aligned above and generally parallel to the smile line; (5) marks are scribed in the fingernail by activating the motorized handset; (6) the fingernail is trimmed so that the point of the new tip is located at the mark scribed by the second blade; (7) the fingernail is backfilled with backfill material; (8) a first color is applied to the portion of the fingernail from the mark scribed by the first blade to the tip; and (9) a second color, contrasting with the first color, is applied between the mark scribed by the first blade to the cuticle. A guide attached to the front of the motorized handset provides further ease in scribing the nail in the correct location.

These and other features, aspects, and advantages of the present invention will become better understood with regard to the following description, appended claims, and accompanying drawings.

DETAILED DESCRIPTION OF THE EMBODIMENTS

Figure 1:
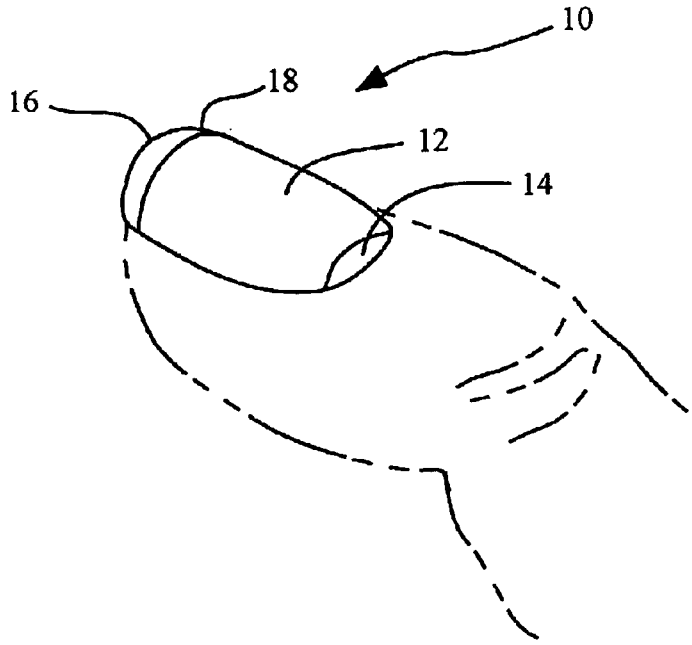
FIG. 1 is a view of a fingertip, showing the major features of the fingernail.

Referring now specifically to the drawings, FIG. 1 shows the major features of the human fingernail 10. The nail plate 12 is a hard keratin coating that protects the fingertip and underlying tissue. The nail bed, which contains blood vessels which supply nutrients to the fingertip, is the portion of skin upon which the nail plate 12 rests. The matrix is that part of the nail bed which extends beneath the nail root and contains lymph and blood vessels. The matrix produces the nail, the cells undergoing a reproducing and hardening process. The lunula 14, or half moon, is located at the base of the nail. The area under the lunula 14 is the front of the matrix. The free edge 16 is the portion of the nail plate 12 not attached to the nail bed, the free edge 16 being the tips of natural fingernails. The natural smile line 18 is the border between the pink or flesh colored nail plate 12 overlying the nail bed and the white free edge 16 of the nail plate 12 extending past the nail bed.

Figure 2:
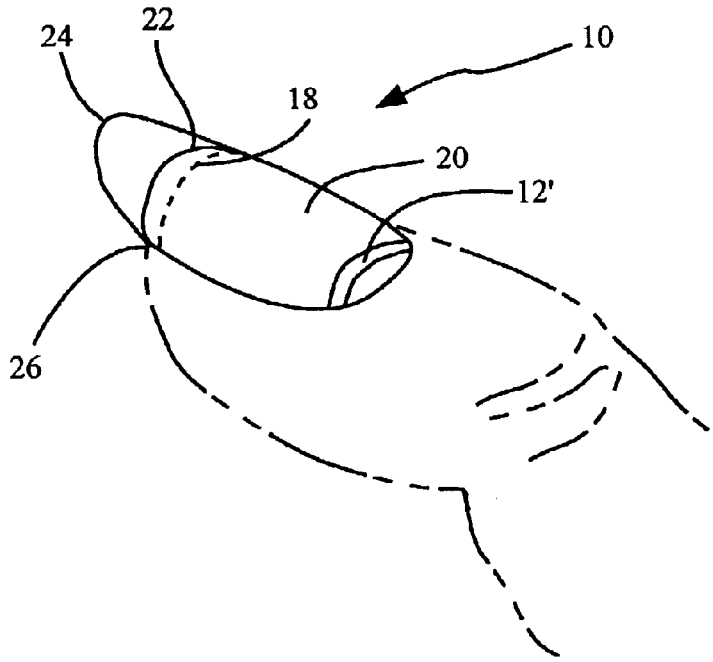
FIG. 2 is a view of a fingertip having an artificial nail enhancement.

An artificial nail enhancement is generally depicted in FIG. 2, where the artificial nail enhancement is in need of maintenance. An overlay 20 of either acrylic or gel has been applied over the nail plate 12. However, a new portion of nail plate 12 is not covered with the overlay 20. The artificial smile line 22, which approximately traced over the natural smile line 18 at the time the artificial enhancement was applied, extends past the natural smile line 18. The artificial tip 24 is extended further out from the fingertip 26 as the nail plate 12 has grown.

Figure 3:
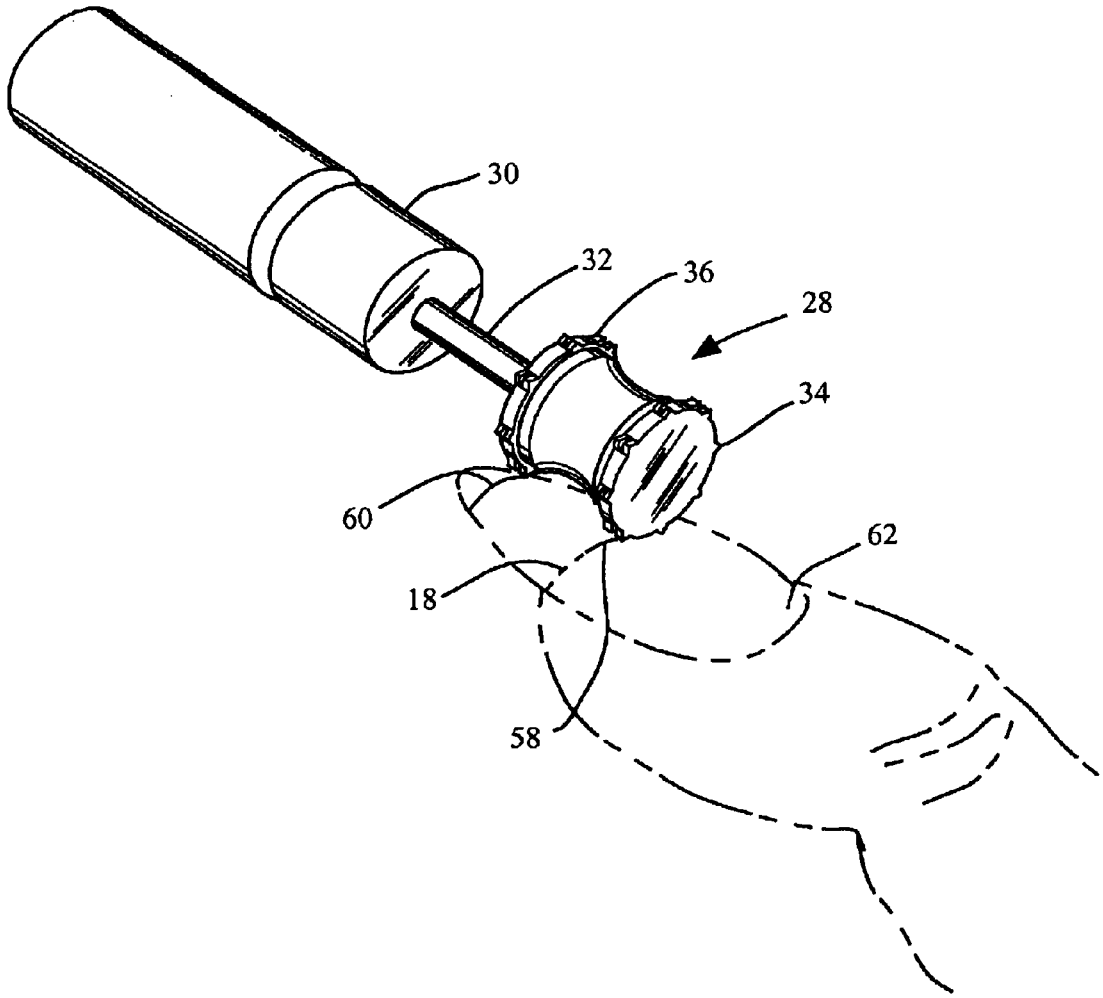
FIG. 3 shows an isometric view of an embodiment of the disclosed apparatus being applied to an artificial nail enhancement.
Figure 4:
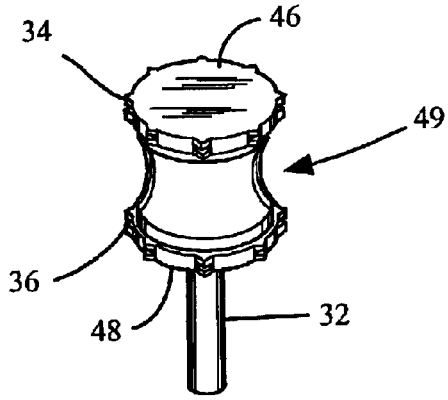
FIG. 4 shows an isometric view of an embodiment of the disclosed apparatus.
Figure 5:
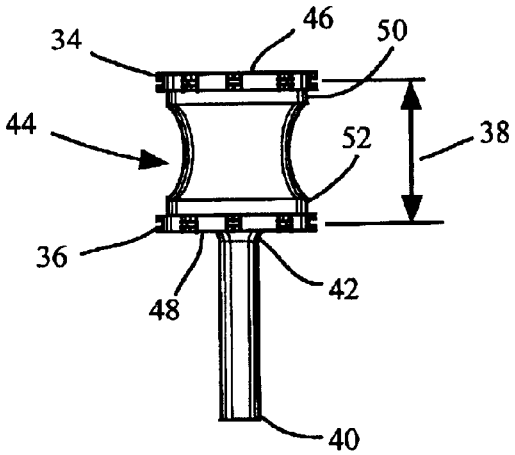
FIG. 5 shows a side elevational view of an embodiment of the disclosed apparatus.
Figure 6:
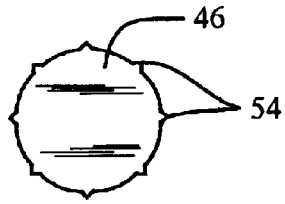
FIG. 6 shows a top view of an embodiment of the disclosed apparatus.
Figure 7:
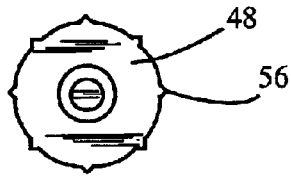
FIG. 7 shows a bottom view of an embodiment of the disclosed apparatus.
Figure 8:
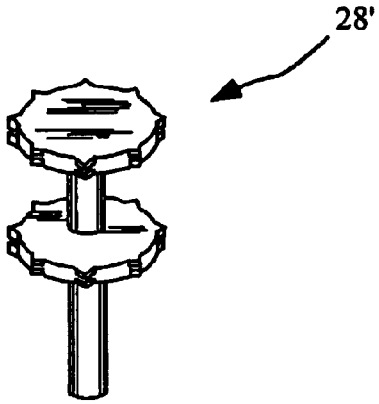
FIG. 8 shows an isometric view of another embodiment of the disclosed apparatus disclosed apparatus.
Figure 9:
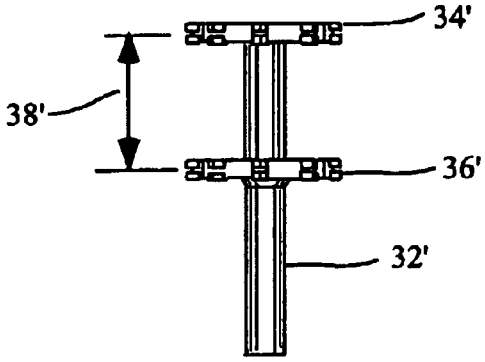
FIG. 9 shows a side elevational view of another embodiment of the disclosed apparatus.
Figure 10:
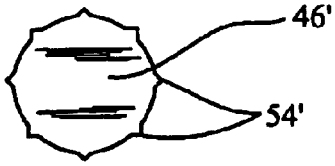
FIG. 10 shows a top view of another embodiment of the disclosed apparatus.
Figure 11:
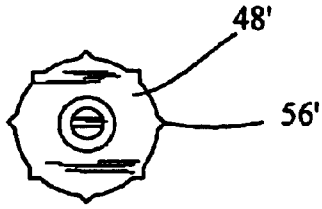
FIG. 11 shows a bottom view of another embodiment of the disclosed apparatus.

FIG. 3 shows one embodiment of the disclosed fingernail marking drill bit 28 in use, mounted in a motorized handset 30. FIGS. 4 through 7 show this embodiment of the marking drill bit 28 in greater detail. The components of this embodiment comprise the shank 32, the first blade 34, and the second blade 36. A gauging segment 38 is defined by the distance between the first blade 34 and the second blade 36. The gauging segment 38 is that portion of the invention which is used to determine the length of a French manicure. As shown in FIG. 2, the length of a French manicure is the distance between the artificial smile line 22 and the artificial tip 24 of the enhanced nail.

The shank 32 has a proximal end 40 and a distal end 42. A barrel 44, having a central axis, extends from the distal end 42 of the shank 32, the central axis of the barrel 44 coinciding with the longitudinal axis of the shank 32. The barrel has a top 46 and a bottom 48, where the bottom 48 is adjacent to the distal end 42 of the shank 32. The first blade 34 is fashioned at the top 46 of the barrel 44, and the second blade 36 is fashioned at the bottom 48 of the barrel 44. As discussed above, the gauging segment 38 is defined by the axial distance along the barrel between the first blade 34 and the second blade 36.

A first circular stop 50 may be fashioned at the top 46 of the barrel 44 adjacent to the first blade 34, where the first circular stop 50 has a smaller diameter than the first blade 34.

The first circular stop 50 limits the depth of penetration of the first blade 34 into the overlay 20, so as to prevent penetration into the nail plate 12. A second circular stop 52 may be fashioned at the bottom 48 of the barrel 44 adjacent to the second blade 36, where the second circular stop 52 has a smaller diameter than the second blade 36. The second circular stop 52 limits the depth of penetration of the second blade 36 into the artificial tip 24.

First blade 34 is configured with first scribing surface 54. Likewise, second blade 36 is configured with second scribing surface 56. It is to be appreciated that because the purpose of the disclosed device is to scribe marks in the overlay 20, a variety of different surfaces might be used for the first scribing surface 54 and the second scribing surface 56. Although FIGS. 4 through 7 depict the first scribing surface 54 and the second scribing surface 56 as having discrete teeth, any variety of surfaces might be employed to scribe the marks in the overlay 20, shown as first mark 58 and second mark 60. For example, instead of discrete teeth, the first scribing surface 54 and second scribing surface 56 may comprise a knurled edge or other abrasive-type surface appropriate for scribing a mark.

It has been found that suitable marks may be scribed by the device if the width of the first scribing surface 54 and the second scribing surface 56, i.e. the widths of the surface creating first mark 58 and second mark 60, are approximately 0.04 inches. It has also been found that a suitable depth for the first mark 58 is reached if the difference in diameter between the first blade 34 and the first circular stop 50 is approximately 0.02 inches, thereby allowing a depth of penetration of 0.02 inches. Likewise, a suitable depth for the second mark 60 is reached if the difference in diameter between the second blade 36 and the second circular stop 52 is approximately 0.02 inches. Shank 32 should be an appropriate diameter for use with commonly known and used motorized handsets. Most motorized handsets 30 use bits having a shank 32 diameter of one-eighth inch or three-thirty-seconds inch. The gauging segment 38 may be any length according to the length desired for the french manicure. The inventor herein has found that a gauging segment 38 length between and including one-fourth inch and one-half inch provides a visually appealing manicure. The disclosed device may be manufactured from any suitably hard material, including stainless steel.

As shown in FIG. 3, the first blade 34 is used to scribe a first mark 58. The manicurist orients the first blade 34 so that it is aligned above and generally parallel to the natural smile line 18, which is normally visible through the acrylic or gel overlay 20. The manicurist then scribes the first mark 58 with the first blade 34 and the second mark 60 with the second blade 36 in the overlay 20 by activating the motorized handset 30. The overlay 20 is trimmed so that the end of the artificial tip 24 coincides with the location of the second mark 60. The overlay 20 is then backfilled with backfill material. A first color, usually white, is applied to the portion of the overlay 20 from the first mark 58 over the artificial tip 24. A second color, contrasting with the first color, and usually being pink or flesh tone, is applied between the first mark and the cuticle 62. The first color and second color may either be an acrylic or a gel.

A second embodiment of the marking drill bit 28 is shown in FIGS. 8 through 11. This embodiment may either be fabricated from a single piece of material, or first blade 34' and second blade 36' may be separate pieces adapted to be attached to shank 32' with set screws or other locking means. A gauging segment 38' is defined by the distance between the first blade 34' and the second blade 36'. As with the first embodiment discussed above, a variety of different surfaces might be used for first scribing surface 54' and second scribing surface 56'.

Figure 12:
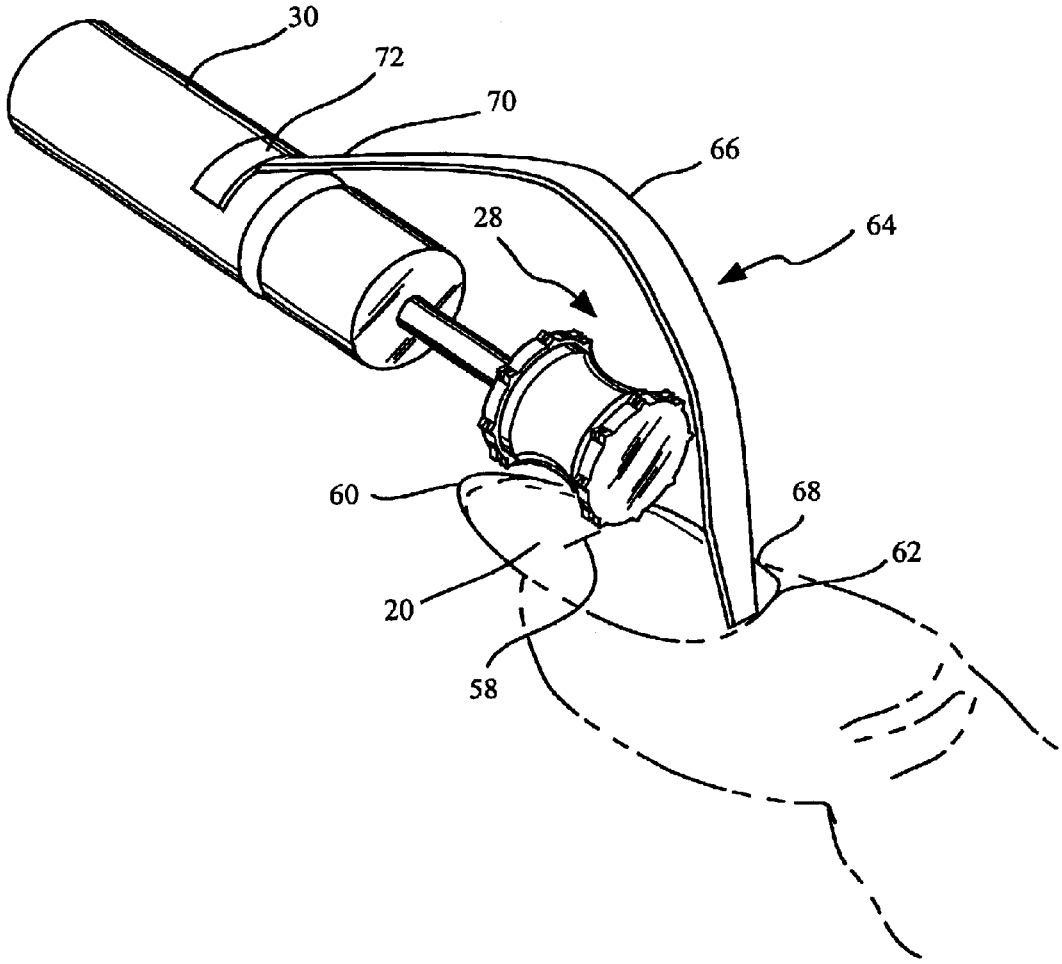
FIG. 12 shows an isometric view of the disclosed apparatus and the disclose guide being applied to an artificial nail enhancement.

FIG. 12 shows how a guide 64 may be attached to the motorized handset 30 to assist the manicurist in determining the position on the overlay 20 for placing the marking drill bit 28. The guide 64 enables the manicurist to scribe a first mark 58 and a second mark 60 at the same position on each nail even if the natural smile line 18 is not visible because a dark acrylic or gel has been applied. Guide 64 may also be used to obtain a uniform manicure on all ten fingers even if the natural smile lines 18 are not uniform on each finger because of injury or other reason. Guide 64 comprises an arcuate member 66 having two ends, the free end 68 and the attaching end 70, the attaching end 70 having fastening means 72 for attaching the guide 64 to the motorized handset 30. Free end 68 is placed at the cuticle 62, thereby providing a uniform distance from the cuticle 62 for scribing first mark 58 and second mark 60 on the overlay 20 of each finger.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A fingernail marking drill bit used in combination with a motorized handset, the drill bit comprising:

(a) a shank having a proximal end and a distal end, the shank having a longitudinal axis defined by the proximal end and distal end;

(b) a barrel, having a central axis, wherein the barrel has the shape of a hyperboloid, the barrel extending from the distal end of the shank, the central axis coinciding with the longitudinal axis of the shank, the barrel further having a top and a bottom, the bottom of the barrel adjacent to the distal end of the shank;

(c) a first circular blade comprising a first scribing surface fashioned at the top of the barrel, and a second blade comprising a second scribing surface fashioned at the bottom of the barrel;

(d) a gauging segment defined by the axial distance between the first blade and the second blade, wherein the gauging segment may be used to determine the length of a french manicure;

(e) a first circular stop fashioned circumferentially at the top of the barrel adjacent to the first blade, the first circular stop having a smaller diameter than the first blade, such that the first circular stop limits the depth of penetration of the first blade; and (f) a second circular stop fashioned circumferentially at the bottom of the barrel adjacent to the second blade, the second circular stop having a smaller diameter than the second blade, such that the second circular stop limits the depth of penetration of the second blade.

2. The fingernail marking drill of claim 1 wherein the first scribing surface and second scribing surface each comprise a knurled edge.

3. A method of doing a french manicure to a fingernail having an existing artificial fingernail enhancement, comprising the steps of:

(a) determining the location of a natural smile line underneath an existing nail enhancement;

(b) placing a drill bit used in combination with a motorized handset on the nail enhancement, the drill bit comprising:

(i) a shank having a proximal end and a distal end;

(ii) a barrel, having a central axis, extending from the distal end of the shank, the central axis coinciding with the longitudinal axis of the shank, the barrel further having a top and a bottom, the bottom of the barrel adjacent to the distal end of the shank;

(iii) a first circular blade fashioned at the top of the barrel, and a second circular blade fashioned at the bottom of the barrel;

(iv) a gauging segment defined by the axial distance along the barrel between the first blade and the second blade, wherein the gauging segment may be used to determine the length of a french manicure;

(c) orienting the first blade so that it is aligned above and generally parallel to the natural smile line;

(d) scribing a first mark with the first blade and a second mark with the second blade in the nail enhancement by activating the motorized handset;

(e) trimming the nail enhancement so that the point of the new tip is located at the second mark;

(f) backfilling the nail enhancement with backfill material;

(g) applying a first color from the first mark to the tip; and (h) applying a second color, contrasting with the first color, to the portion of the nail enhancement between the first mark to the cuticle.

4. The method of claim 3 wherein the first color and second color are an acrylic.

5. The method of claim 3 wherein the first color and second color are a gel.

6. A method of doing a french manicure to a fingernail having an existing artificial fingernail enhancement, comprising the steps of:

(a) using a guide to determine the position on the fingernail to place a drill bit used in combination with a motorized handset, the guide comprising an arcuate member having two ends, the free end and the attaching end, the attaching end having fastening means for attaching the guide to the motorized handset, the length between the free end and the attaching end defining a fixed distance placement of the drill bit on the fingernail;

(b) placing a drill bit on the fingernail according to the position indicated by the guide, the drill bit comprising:

(i) a shank having a proximal end and a distal end;

(ii) a barrel, having a central axis, extending from the distal end of the shank, the central axis coinciding with the longitudinal axis of the shank, the barrel further having a top and a bottom, the bottom of the barrel adjacent to the distal end of the shank;

(iii) a first blade fashioned at the top of the barrel, and a second blade fashioned at the bottom of the barrel;

(iv) a gauging segment defined by the axial distance along the barrel between the first blade and the second blade, wherein the gauging segment may be used to determine the length of a french manicure;

(c) scribing a first mark with the first blade and a second mark with the second blade in the fingernail by activating the motorized handset;

(d) trimming the fingernail so that the point of the new tip is located at the second mark;

(e) backfilling the fingernail with backfill material;

(f) applying a first color from the first mark to the tip; and (g) applying a second color, contrasting with the first color, to the portion of the fingernail between the first mark to the cuticle, scribing marks in the fingernail by activating the motorized handset.

7. The method of claim 6 wherein the first color and second color are an acrylic.

8. The method of claim 6 wherein the first color and second color are a gel.

* * * * *